US006244591B1

(12) United States Patent
Paulat

(10) Patent No.: US 6,244,591 B1
(45) Date of Patent: Jun. 12, 2001

(54) SHUNT FOR REVERSING THE CONVEYANCE DIRECTION OF A DOCUMENT

(75) Inventor: Klaus Paulat, Schoneburg/Schwendi (DE)

(73) Assignee: BDT Buro-und Datentechnik GmbH & Co. KG., Rottweil (DE)

( * ) Notice: Subject to any disclaimer, the term of this patent is extended or adjusted under 35 U.S.C. 154(b) by 0 days.

(21) Appl. No.: 09/405,123

(22) Filed: Sep. 24, 1999

(30) Foreign Application Priority Data

Sep. 26, 1998 (DE) ..... 198 44 230

(51) Int. Cl.[7] ..... B65H 5/00
(52) U.S. Cl. ..... 271/225; 271/184; 271/902
(58) Field of Search ..... 271/184, 185, 271/186, 902, 225

(56) References Cited

U.S. PATENT DOCUMENTS 3,942,785 * 3/1976 Stange ..... 271/902
4,486,012 * 12/1984 Bock et al. ..... 271/902
4,699,367 * 10/1987 Russel ..... 271/902
5,449,164 * 9/1995 Quesnel et al. ..... 271/902
5,449,166 9/1995 Lohmann et al. .
5,629,762 * 5/1997 Mahoney et al. ..... 271/186
5,690,325 * 11/1997 Morimoto ..... 271/902

FOREIGN PATENT DOCUMENTS 011 85 994 1/1965 (DE) .
32 17 115 A1 11/1983 (DE) .
195 06 181 A1 2/1995 (DE) .

* cited by examiner

*Primary Examiner*—H. Grant Skaggs
(74) *Attorney, Agent, or Firm*—Foley & Lardner; Bernard L. Kleinke

(57) ABSTRACT

A shunt is described for reversing the direction of conveyance of a document or the like. The document is accepted by a front-end roller and supplied to a reversing roller. As soon as the trailing rear edge of the document has left the front-end roller, the direction of rotation of the reversing roller is reversed and this guides the document, with the rear edge leading, to an output roller which is disposed offset in height relative to the front-end roller and outputs the document in the opposite direction.

11 Claims, 2 Drawing Sheets

SHUNT FOR REVERSING THE CONVEYANCE DIRECTION OF A DOCUMENT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention is transporting sheets in an office machine. More specifically, the invention relates to a shunt for reversing the conveyance direction of a document or the like.

2. Background Art

With office machines such as printers, copiers and the like, it is frequently desirable to reverse the conveyance direction of a document. The document is, for example, a paper sheet or the like provided with recordings. Reversing the document needs to be accomplished such that the document is transported first with its front edge leading, and is then further conveyed with its rear edge leading.

Others have addressed reversing the conveyance of a sheet of paper. For example, it is known from DE 32 17 115 A1 to accept the leading edge of an arriving document with a reversible roller pair whose direction of rotation can be reversed. In front of the reversible roller pair is disposed a pivotable guidance roller. When the document has been pulled in by the reversible roller pair such that the document's rear edge has reached the guidance roller, the direction of rotation of the reversible roller pair is reversed and the guidance roller is pivoted such that the document is steered by the guidance roller into the desired direction for further conveyance with the document's rear edge leading. This known shunt has the disadvantage that a succeeding next document can only be supplied to the reversing roller pair when the preceding document has been completely output by the reversing roller pair. Consequently the shunt hinders the conveyance of the documents and limits the continuity of document conveyance.

In another known example, DE 195 06 181 A1 shows a shunt where a sheet is supplied by front-end rollers to a reversible roller pair whose direction of rotation is reversible. The reversible roller pair accepts the sheet supplied by the front-end rollers and conveys it until the rear edge of the sheet is released by the front-end rollers and has been pulled over a wedge-form shunt element. The direction of rotation of the reversing roller pair is subsequently reversed such that the rear edge of the document is now leading and is transported past the shunt element to the output rollers. As soon as the output rollers have taken hold of the sheet and are conveying it in the output direction, the reversing roller pair is opened such that the next succeeding sheet can be guided by the front-end rollers into the open gap of the reversing roller pair. It is thereby possible to guide the particular succeeding next sheet into the reversing roller pair before the preceding sheet is completely pulled out of the reversing roller pair. The front-end roller and the output roller cooperates with a common pressure roller such that the drawing-in speed of the front-end roller and the output speed of the output rollers are, by necessity, equal. The output speed thereby limits the drawing-in speed of the front-end roller.

Thus, there exists a need for a shunt which makes possible a closer continuity sequence of the conveyed documents.

SUMMARY OF THE INVENTION

In a shunt for reversing the conveyance direction of a document, the document is completely drawn in by a front-end roller pair and are output again in the opposite direction via a separate output roller pair. After the front-end roller pair, the leading edge of the document is accepted by a reversing roller. After the document is released from the front-end roller pair, the direction of rotation of the reversing roller is reversed. The document is then transported to an output roller pair which continues to transport the document. A pressure roller, which can be pivoted toward the document, holds the document in engagement with the reversing roller. When the reversing roller has conveyed the document such that its rear edge, now leading, has been taken hold of by the output roller pair, the pressure roller can be pivoted away from the revering roller so that a succeeding document, which has already been taken hold of by the front-end roller pair, can be guided between the reversing roller. The pressure roller can thereby be pivoted away. While the output roller pair outputs the preceding document in the opposite direction, the front-end roller pair can already be drawing in the succeeding document.

Advantageously, successive documents can thus overlap preceding documents within the shunt. In such a manner a closer sequential continuity of document conveyance is possible. The output roller pair and the front-end roller pair are independent of one another so that, for example, the output roller pair can guide the document away at a higher velocity than that achieved by the front-end rollers. The shunt thereby does not introduce a delay to document conveyance.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
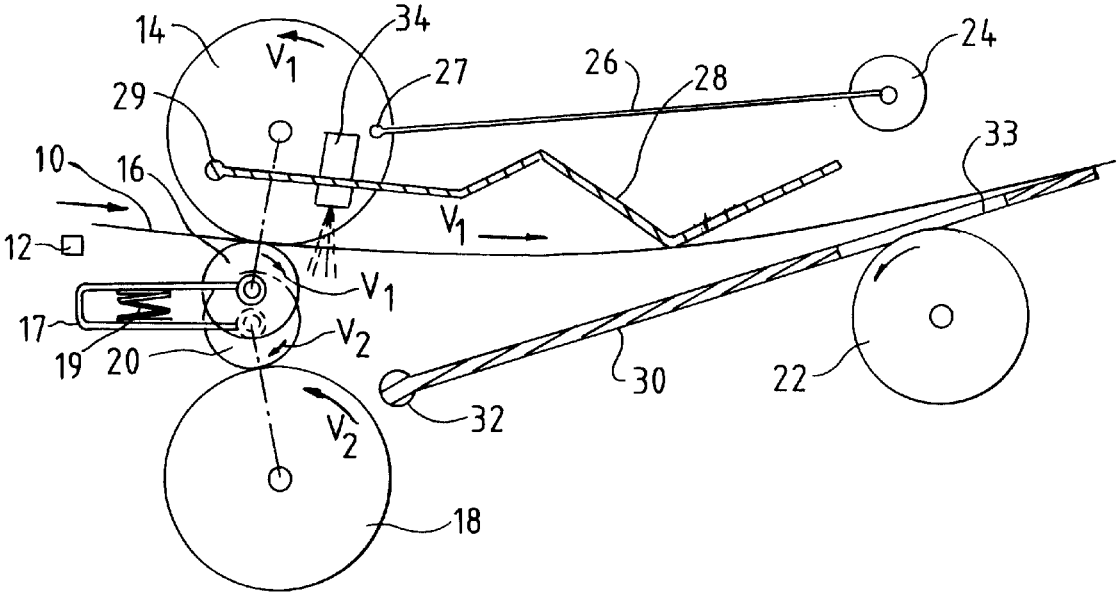
FIG. 1. is a schematic vertical section showing the shunt made in accordance with the present invention in the acceptance position.

Referring now to FIG. 1, there is shown a shunt made in accordance with the present invention. The shunt receives a sheet-form document 10 from an office machine, for example a printer, which the document 10 supplied to the shunt from the left as shown in FIG. 1. In the document supply path is disposed a first sensor 12. As indicated by the arrow 11 in FIG. 1, the arriving document 10 arrives at a front-end roller 14. The front-end roller 14 is driving at the circumferential speed $V_1$. A pressure roller 16 cooperates with the front-end roller 14 in order to bring the document 10 and the front-end rollers 14 into frictional engagement. Those skilled in the art will recognize that the front-end roller 14 can comprise a cylinder, extending over the width of the document, or several rollers disposed on a common shaft.

An output roller 18, offset in height, is disposed below the front-end roller 14 and axis-parallel with it. The output roller 18 is drivable with the circumferential speed $V_2$, and cooperates with a pressure roller 20. The output roller 18 can also comprise a continuous cylinder or several discrete rollers disposed on a common shaft. Typically, the circumferential speed $V_2$ will be greater than the circumferential speed $V_1$.

The pressure rollers 16 and 20 are each freely rotatable and supported on legs of a brace 17. The pressure rollers 16 and 20 are held in contact on the front-end roller 14 and the output roller 18 by a spring 19. The pressure roller 16 consequently rotates at speed $V_1$ while the pressure roller 20 rotates at speed $V_2$.

A drivable reversing roller 22 is disposed axis-parallel with the front-end roller 14 and with the output roller 18. More specifically the reversing roller 22 is positioned on the side facing away from the arriving side of the front rollers behind the front-end roller 14 and the output roller 18 and, spaced apart therefrom This reversing roller 22 can also comprise a continuous cylinder or several discrete rollers disposed on a common shaft. The reversing roller 22 can be reversed under control and is drivable in both directions of rotation. A pressure roller 24 cooperates with the reversing roller 22 which is supported freely rotatably on the free end of a roller lever 26. The roller lever 26 is pivotably supported at 27 in such a way that the pressure roller 24 can be pivoted between a position shown in FIG. 1 away from the reversing roller 22 and a position shown in FIG. 2 resting on the reversing roller 22.

Adjacent to the roller lever 26 is connected a pivot flap 28 which extends substantially over the width of the document 10 and extends generally from a pivot bearing 29 in the region of the front-end roller 14 to the pressure roller 24.

Figure 2:
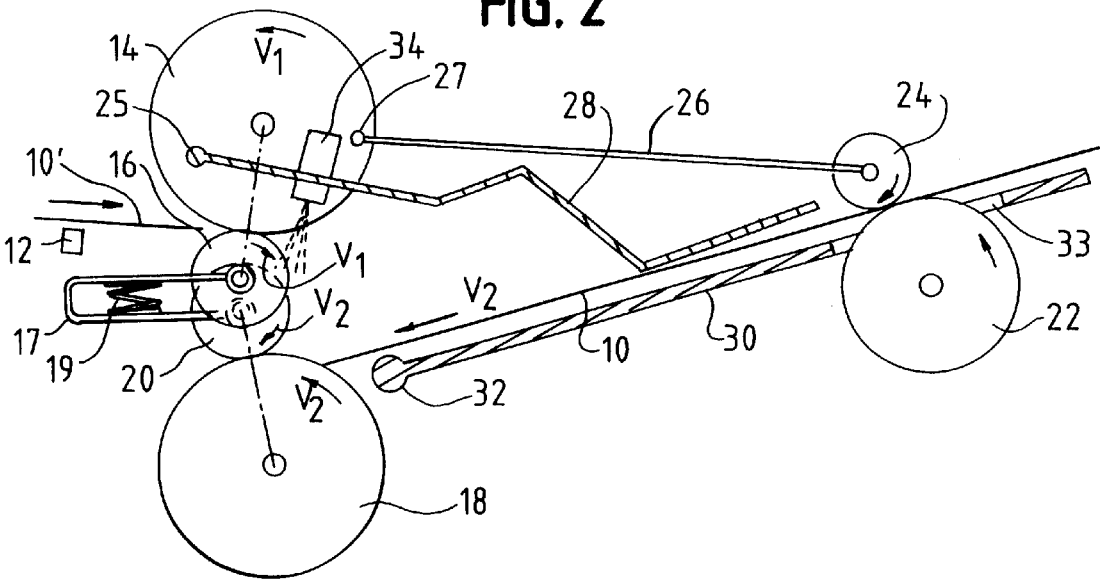
FIG. 2 is a schematic of the shunt of FIG. 1 showing the shunt in the reversing position.

Adjacent to the output roller 18 is a guidance flap 30, which is articulated pivotably about an axle 32. The free end of the guidance flap 30 extends beyond the reversing roller 22 and comprises cutouts 33 in which the reversing roller 22 can extend through. The guidance flap 30 is pivotable between an upper position as depicted in FIG. 1 and a lower position as depicted in FIG. 2. In the upper position (FIG. 1) the plane of the guidance flap 30 is outside of the circumference of the reversing roller 22. In the lower pivot position (FIG. 2) the plane of the guidance flap 30 intersects the reversing roller 22 such that the latter extends through the cutouts 33 of the guidance flap 30. In such a manner, the reversing roller 22 projects with its circumference above the top side of the guidance flap 30. The roller lever 26 is preferably coupled with the pivot flap 28 and the guidance flap 30 such that these are pivoted jointly between the positions shown in FIGS. 1 and 2.

The operation of the shunt will now be discussed. A document 10 arrives from a printer in the direction of the arrow 11 as shown in FIG. 1. The arriving document 10 is detected at its front edge by the sensor 12 whereupon the driving of the front-end roller 14 is started. The front-end roller 14 is driven in the drawing-in direction i.e. in the drawing in the counterclockwise rotation. The pressure roller 24 is raised by means of the roller lever 26 from the reversing roller 22 and pivoted upward. The guidance flap 30 is also pivoted upward such that it is located above the outer circumference of reversing roller 22. The front edge of the incoming document 10 is taken hold of between the front-end roller 14 and its pressure roller 16. As the document 10 is drawn in, the document 10 actuates a second sensor 34 which is disposed in the region of the entry gap of the front-end roller 14. A signal from the second sensor 34 initiates the driving of the output roller 18, in the counterclockwise direction as shown in FIG. 3.

As soon as the trailing rear edge of document 10 has passed the first sensor 12, a signal from sensor 12 causes both the roller lever 26 (with the pressure roller 24) and the guidance flap 30 to be lowered from the position depicted in FIG. 1 into the position as shown in FIG. 2. The driving of the reversing roller 22 is set such that the reversing roller 22 rotates in the clockwise direction and has the same circumferential speed $V_1$ as the front-end roller 14. The rpm of the front-end roller 14 can simultaneously be increased and thus the conveyance of the document 10 can be accelerated. With the lowering of the pressure roller 24 the leading front edge of document 10 can be clamped between the pressure roller 24 and the reversing roller 22, and together with the front-end roller 14, can convey the document farther to the right, as shown in the figures.

As soon as the trailing rear edge of document 10 has passed the second sensor 34 and is thus released from the front-end roller 14, the signal of sensor 34 causes the pivot flap 28 to be pivoted downward. In such a manner, the rear region of the document 10 is pushed by the pivot flap 28 downwardly onto the guidance flap 30, as is shown in FIG. 2. The signal from the second sensor 34 also reverses the direction of rotation of the reversing roller 22 so that the reversing roller 22 now rotates, in the representation of the drawing, in the counterclockwise direction and thereby conveys the document 10 to the left, as is shown in FIG. 2 by the arrow 13. The rear edge of document 10 arrives thereby at the output roller 18 and is taken hold of by this output roller 18 and its pressure roller 20 and conveyed further. The driving of the reversing roller 22 takes place at the same circumferential speed $V_2$ as the driving of output roller 18.

Figure 3:
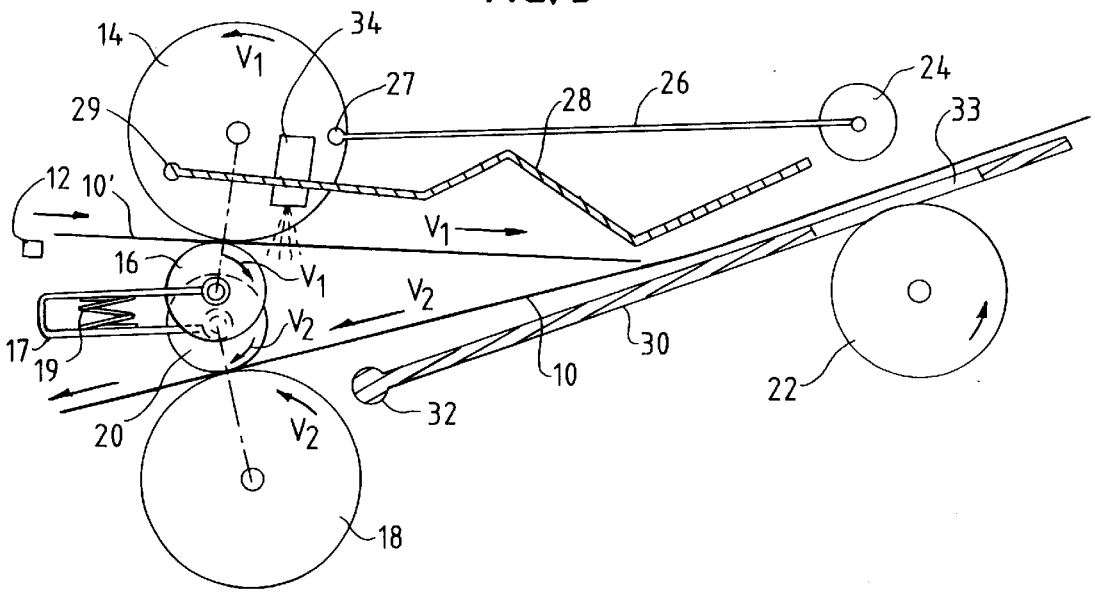
FIGS. 3–4 are schematic of the short of FIG. 1 showing the overlapping of acceptance and output of two successive documents.

Now roller lever 26, the connected pivot flap 28, and the guidance flap 30 are pivoted upwardly as is shown in FIG. 3. Thereby the shunt is ready to accept the succeeding next document 10'.

Figure 4:
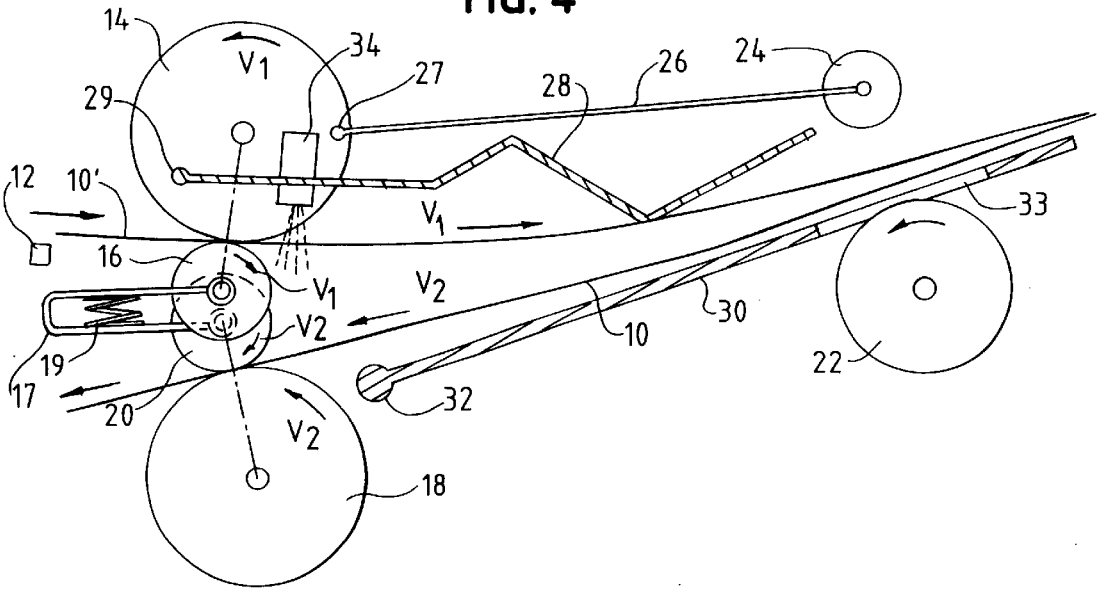

As is shown in FIG. 3 the succeeding next document 10' can already be accepted and drawn in through the front-end roller 14 while the preceding document 10 is still being conveyed and output by the output roller 18. Indeed, with the guidance flap 30 raised beyond the circumference of the reversing roller 22, which is now driven again in the clockwise direction, does not hinder the drawing-off of document 10 by the output roller 18. The succeeding next document 10' can thus be drawn into the reversing roller 22 overlapping the preceding document even though the preceding document 10 has not been output completely via the output roller 18. Further, the document can be drawn with the higher speed $V_2$ from the reversing roller 22, as is shown in FIG. 4. Thereby a higher document sequential throughout can be attained. In such a manner the shunt does not delay the usual conveyance documents output from an office machine.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A shunt for reversing the conveyance direction of a document, comprising:

a front-end roller pair for accepting the incoming document at its front edge;

an output roller pair disposed axis-parallel and offset with respect to the front-end roller pair, the output roller pair for outputting the document with its rear edge leading in the opposite direction;

a reversing roller disposed axis-parallel on the side opposing the incoming side of the front-end roller pair and of the output roller pair; and a guidance flap for raising the document from a circumference of the reversing roller when the rear edge of document has been taken hold of by the output roller pair and the document is being conveyed by the output roller pair, wherein the reversing roller takes hold of the document conveyed by the front end roller pair and transports the document further until the rear edge of document has left the front-end roller pair and subsequently reverses direction of rotation of the reversing roller to transport the rear edge of document to the output roller pair.

2. The shunt according to claim 1, wherein the reversing roller is associated with a pressure roller, the pressure roller being pivotable toward the reversing roller and away from the reversing roller, and wherein the pressure roller is pivoted against the reversing roller at least during the time interval before the rear edge of the document has left the front-end roller pair until the rear edge of document has been taken hold of by the output roller pair.

3. The shunt according to claim 2 wherein the guidance flap pivots, and the pivot motion of the guidance flap is coupled with a pivot motion of the pressure roller.

4. The shunt according to claim 1, further including a pivot plate for urging the rear edge of document toward entry to the output roller pair after the document leaves the front-end roller pair.

5. The shunt according to claim 4 wherein the pivot plate pivots, and the pivot motion of the pivot plate is coupled with a pivot motion of a pressure roller.

6. The shunt according to claim 1, wherein a circumferential speed of the output roller pair is greater than the circumferential speed of the front-end roller pair.

7. A shunt for reversing the conveyance direction of a document, comprising:

a front-end roller pair for accepting the incoming document at its front edge;

an output roller pair disposed axis-parallel and offset with respect to the front-end roller pair, the output roller pair for outputting the document with its rear edge leading in the opposite direction;

a reversing roller disposed axis-parallel on the side opposing the incoming side of the front-end roller pair and of the output roller pair; and a pivot plate for urging the rear edge of document toward entry to the output roller pair after the document leaves the front-end roller pair, wherein the reversing roller takes hold of the document conveyed by the front end roller pair and transports the document further until the rear edge of document has left the front-end roller pair and subsequently reverses direction of rotation of the reversing roller to transport the rear edge of document to the output roller pair, and wherein the pivot plate pivots, and the pivot motion of the pivot plate is coupled with a pivot motion of a pressure roller.

8. The shunt according to claim 7, wherein the reversing roller is associated with the pressure roller, the pressure roller being pivotable toward the reversing roller and away from the reversing roller, and wherein the pressure roller is pivoted against the reversing roller at least during the time interval before the rear edge of the document has left the front-end roller pair until the rear edge of document has been taken hold of by the output roller pair.

9. The shunt according to claim 7, further including a guidance flap for raising the document from a circumference of the reversing roller when the rear edge of document has been taken hold of by the output roller pair and the document is being conveyed by the output roller pair.

10. The shunt according-to claim 9, wherein the guidance flap pivots, and the pivot motion of the guidance flap is coupled with a pivot motion of the pressure roller.

11. The shunt according to claim 7, wherein a circumferential speed of the output roller pair is greater than the circumferential speed of the front-end roller pair.

* * * * *